US010041778B2

(12) United States Patent
Guyon et al.

(10) Patent No.: US 10,041,778 B2
(45) Date of Patent: Aug. 7, 2018

(54) ELECTRONIC DETONATOR

(71) Applicant: DAVEY BICKFORD, Hery (FR)

(72) Inventors: Franck Guyon, Auxerre (FR); Michel Boulmeau, Saint-Florentin (FR)

(73) Assignee: DAVEY BICKFORD, Hery (FR)

( * ) Notice: Subject to any disclaimer, the term of this patent is extended or adjusted under 35 U.S.C. 154(b) by 0 days.

(21) Appl. No.: 15/039,445

(22) PCT Filed: Nov. 17, 2014

(86) PCT No.: PCT/FR2014/052937

§ 371 (c)(1),
(2) Date: May 26, 2016

(87) PCT Pub. No.: WO2015/079142

PCT Pub. Date: Jun. 4, 2015

(65) Prior Publication Data

US 2017/0003108 A1 Jan. 5, 2017

(30) Foreign Application Priority Data

Nov. 28, 2013 (FR) ..... 13 61781

(51) Int. Cl.
*F42D 1/05* (2006.01)
*H01B 1/12* (2006.01)

(52) U.S. Cl.
CPC ..... *F42D 1/05* (2013.01); *H01B 1/12* (2013.01)

(58) Field of Classification Search
CPC .. F42D 1/045–1/055; F42D 1/05; G01V 1/06; E21B 43/1185; E21B 43/11857; E21B 47/12
See application file for complete search history.

(56) References Cited

U.S. PATENT DOCUMENTS 2,933,653 A 4/1960 Carter
4,157,069 A * 6/1979 Gustafsson ..... F42D 1/05 102/200
4,454,814 A * 6/1984 Henry ..... E21B 43/11857 102/200
4,537,131 A * 8/1985 Saunders ..... F42D 1/055 102/200

(Continued)

FOREIGN PATENT DOCUMENTS

FR 1363336 6/1964

OTHER PUBLICATIONS

International Search Report PCT/FR2014/052937 dated Feb. 18, 2015.

*Primary Examiner* — Stephen Johnson
*Assistant Examiner* — Joshua T Semick
(74) *Attorney, Agent, or Firm* — Young & Thompson

(57) ABSTRACT

An electronic detonator (1) designed to be connected by two conducting wires (a, b) to an associated control system (20), the conducting wires (a, b) including a charged plastic material and exhibiting a first resistance. The electronic detonator (1) includes supervision elements (11) and resistive elements (12) disposed between the two conducting wires (a, b), the resistive element (12) exhibiting a second resistance, the second value of resistance being determined by the supervision elements (11) in such a way that the sum of the values of the first resistance and of the second resistance is a predetermined value.

19 Claims, 1 Drawing Sheet

(56) References Cited

U.S. PATENT DOCUMENTS

| | | | | | |
|---|---|---|---|---|---|
| 4,559,875 | A * | 12/1985 | Marshall | F42C 11/00 | 102/206 |
| 4,586,437 | A * | 5/1986 | Miki | F42C 11/06 | 102/206 |
| 4,652,876 | A * | 3/1987 | Darilek | E21B 34/16 | 340/854.9 |
| 5,520,114 | A * | 5/1996 | Guimard | F42D 1/055 | 102/206 |
| 5,539,375 | A * | 7/1996 | Atherton | E21B 47/12 | 307/127 |
| 6,191,625 | B1 * | 2/2001 | Wachter | B60R 21/017 | 327/108 |
| 6,618,237 | B2 * | 9/2003 | Eddy | F42B 3/121 | 102/217 |
| 7,154,733 | B2 * | 12/2006 | Sibrai | B60R 21/0173 | 361/248 |
| 8,502,077 | B2 * | 8/2013 | Kay | F42D 1/043 | 102/202.5 |
| 8,582,275 | B2 * | 11/2013 | Yan | F42C 11/065 | 102/202 |

* cited by examiner

ELECTRONIC DETONATOR

BACKGROUND OF THE INVENTION

Field of the Invention

The present invention relates to an electronic detonator.

In particular, it relates to an electronic detonator designed to be connected by means of two conducting wires to an associated control system, the conducting wires comprising a charged plastic material.

Description of the Related Art

Electronic detonators comprise in particular an explosive, an electrically-controlled blasting cap and an electronic module. The electronic detonator is connected to a control system by means of conducting wires.

The control system sends the power and control signals to the electronic detonator via the conducting wires. The electronic detonator also sends signals, particularly response signals, to the control system via the conducting wires.

Generally, the conducting wires connecting an electronic detonator to an associated control system comprise a metal material.

In some cases, the conducting wires comprise a charged plastic material instead of the metal material conventionally used.

The electrical resistance of such conducting wires has a high value. Generally, this resistance has no impact on the control signals transmitted by the control system to the electronic detonator.

However, the resistance of the conducting wires has an impact on the signals generated by the electronic detonator to the control system.

In fact, when the electronic detonator generates a signal to the control system, it generates in the conducting wires, a current for example, that has an amplitude proportional to the value of a resistance formed in part by the resistance of the conducting wires.

The value of the resistance of the conducting wires is variable, for example depending on the length of the wires or the installation conditions of the wires in the field. As a result, the amplitude of the current generated by the electronic detonator is variable, and means for detecting the current in the control system must be adapted to detect currents with a wide range of amplitude values.

BRIEF SUMMARY OF THE INVENTION

The purpose of the present invention is to propose an electronic detonator generating signals to an associated control system such that the control system can be optimized.

To this end, according to a first aspect the present invention relates to an electronic detonator designed to be connected by means of two conducting wires to an associated control system, the conducting wires comprising a charged plastic material and having a first resistance.

According to the invention, the electronic detonator comprises control means and resistive means arranged between the two conducting wires, the resistive means having a second resistance, the value of the second resistance being determined by the control means such that the sum of the values of the first resistance and the second resistance is substantially equal to a predetermined value.

Thus, the resistance formed by the resistance of the conducting wires and the resistance of the resistive means has a constant value and does not depend on the length of the conducting wires or the installation conditions of the conducting wires in the field.

Detection by the control system of the signals generated by the electronic detonator is thus optimized and more reliable.

According to an embodiment, the resistive means comprise an MOS transistor.

For example, the electronic detonator comprises switching means arranged in series with the resistive means, the switching means being capable of having a closed state in which the resistive means are connected to the two conducting wires, or an open state in which the resistive means are disconnected from at least one of the two conducting wires.

According to a second aspect, the present invention relates to an electronic detonation system comprising an electronic detonator according to the invention and an associated control system, the associated control system being connected to said at least one electronic detonator by means of two conducting wires.

For example, the control system comprises second switching means arranged between the two conducting wires, the switching means being capable of having an open state in which the two conducting wires are not electrically connected, or a closed state in which the two conducting wires are electrically connected.

According to a third aspect, the present invention relates to a method for the compensation of a resistance value in an electronic detonator, the electronic detonator being designed to be connected by means of two conducting wires to an associated control system, the conducting wires comprising a charged plastic material and having a first resistance.

According to the invention, the electronic detonator comprising resistive means arranged between the two conducting wires and having a second resistance, the method comprises determining the value of the second resistance such that the sum of the values of the first resistance and the second resistance is substantially equal to a predetermined value.

Thus, the resistance formed by the resistance of the conducting wires and the resistive means has a constant value.

As a result, this resistance value does not depend on the length of the conducting wires, or the installation conditions of the wires in the field.

In fact, when the length of the conducting wires and/or the installation conditions in the field vary, the variation in the value of the resistance formed by the resistance of the conducting wires is compensated by determining the value of the second resistance.

The signals generated by the electronic detonator to the control system then have a constant amplitude and detecting this amplitude in the control system is optimized and more reliable.

In practice, the compensation method comprises measuring the value of the first resistance.

For example, measuring the value of the first resistance comprises applying a predetermined voltage across the two conducting wires, and measuring the current passing through the two conducting wires when they are electrically connected together.

In an embodiment, measuring the value of the first resistance is implemented by control means in the electronic detonator.

In another embodiment, measuring the value of the first resistance is implemented by control means in the control system.

In yet another embodiment, the value of the first resistance is a predefined value.

For example, the compensation method is implemented by the electronic detonator when the control system transmits a command for compensation of a value of the resistance.

For example, the compensation command contains said predetermined value.

In another example, the compensation command contains the predefined value.

In an embodiment, the compensation method comprises sending the predetermined value to the electronic detonator, the predetermined value being stored in storage means in the electronic detonator, sending being implemented prior to the transmission of the compensation command.

In another embodiment, the compensation method comprises sending the predefined value to the electronic detonator, said predetermined value being stored in storage means in the electronic detonator, sending being implemented prior to the transmission of the compensation command.

In an embodiment, the compensation method is implemented by the control system and also comprises a step of setting the second resistance to a determined value.

The electronic detonation system and the compensation method have characteristics and advantages similar to those previously described with respect to the electronic detonator.

BRIEF DESCRIPTION OF THE DRAWINGS

Other features and advantages of the invention will become more apparent in the description hereinafter.

In the attached drawings, given by way of non-limitative example.

DETAILED DESCRIPTION OF THE PREFERRED EMBODIMENTS

Figure 1:
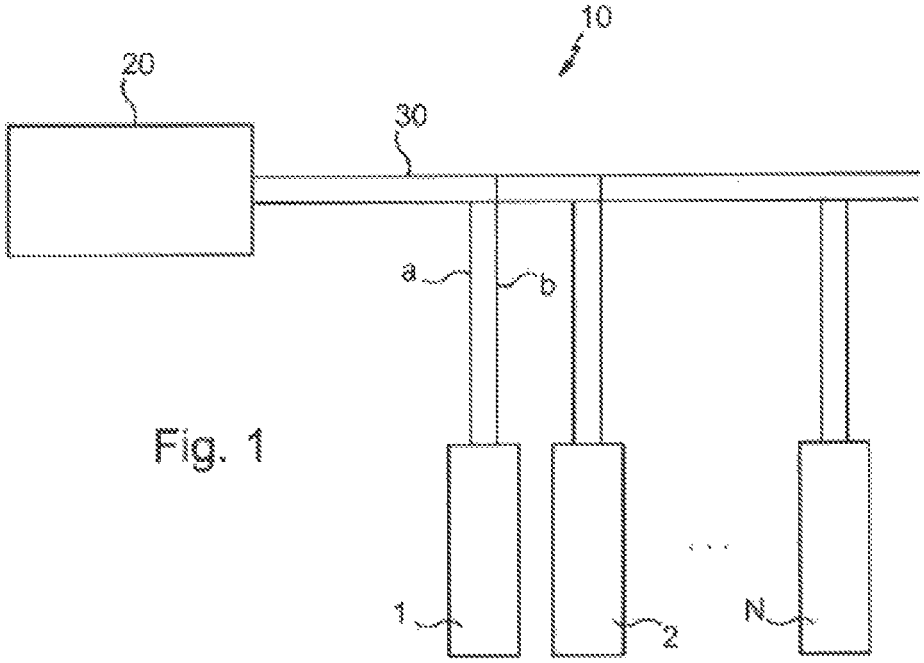
FIG. 1 shows an electronic detonation system according to the invention.

The electronic detonation system 10 shown in FIG. 1 comprises a set of electronic detonators 1, 2, . . . N.

Each electronic detonator 1, 2, . . . N is connected to a control system 20.

The control system 20 is required in particular to supply the electronic detonators 1, 2, . . . N with power, to verify that they are operating correctly and to manage their operation, for example to control their firing.

In particular, the control system 20 is configured to direct signals to the electronic detonators 1, 2 . . . N, for example firing or test signals.

The electronic detonator 1, 2, . . . N also generates signals to the control system 20. These signals are signals in response to the control system 20, such as a signal informing that a command has been received or a signal in response to a test command directed by the control system 20 in order to verify the correct operation of the electronic detonator 1, 2, . . . N.

In the embodiment described, the control system 20 and the electronic detonators 1, 2, . . . N communicate with each other using a communication bus 30.

In the example described, each electronic detonator 1, 2, . . . N is connected in parallel to the communication bus 30, by means of two conducting wires a, b.

Thus, each electronic detonator 1, 2, . . . N is designed to be connected to the control system 20 by means of two conducting wires a, b and by the communication bus 30.

For example, the communication bus 30 comprises wires with a copper conductor.

Of course, other types of metal conductors can be used.

In another embodiment, each electronic detonator 1, 2, . . . N is connected directly to the control system 20 by means of two electrical wires a, b, i.e. the electronic detonators 1, 2, . . . N do not communicate with the control systems 20 via a communication bus.

In an embodiment, the conducting wires comprise a charged plastic material. The conducting wires a, b, corresponding to each electronic detonator 1, 2, . . . N have a first resistance.

By way of a non-limitative example, the value of the first resistance is 70 Ohm/meter.

Figure 2:
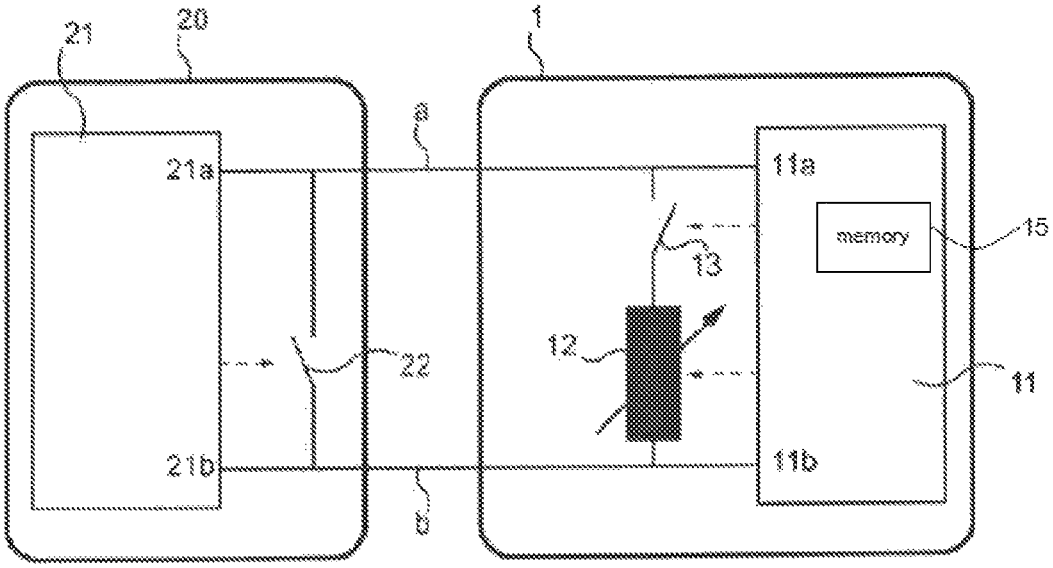
FIG. 2 shows an electronic detonator according to the invention and an associated control system.

FIG. 2 shows a single electronic detonator 1, connected to an associated control system 20. The electronic detonator 1 and the control system 20 are connected together by two conducting wires a, b.

It will be noted that the example shown in FIG. 2 is an electronic detonation system, simplified so as to describe the operation of such a system.

It will be noted that there is no communication bus in this simplified example.

The electronic detonator 1 comprises control means 11 configured in order to manage the operation of the electronic detonator 1. The control means 11 receive commands originating from the control system 20, and control the operation of the electronic detonator 1 depending on the commands received and/or transmit response messages to the control system 20.

The control means 11 comprise two input/output terminals 11*a*, 11*b*, to which the conducting wires a, b are respectively connected.

The electronic detonator 1 also comprises resistive means 12 arranged between the two input/output terminals 11*a*, 11*b*, i.e. arranged between the two conducting wires a, b. The resistive means 12 have a second resistance, the value of this second resistance being variable and fixed by the control means 11.

The control means 11 apply a signal to the resistive means 12 in order to set its resistance to the value of the second resistance.

The value of the second resistance is a value such that the sum of the value of the first resistance and the value of the second resistance is a predetermined value.

In an embodiment, the resistive means 12 comprise an MOS transistor.

Thus, in this embodiment, the control means 11 apply a voltage to the resistive means 12 so as to set its resistance to the value of the second resistance.

The electronic detonator 1 also comprises first switching means 13 arranged in series with the resistive means 12, i.e. between the two electrical wires a, b. The first switching means 13 can have a closed state or an open state.

When the first switching means 13 are in a closed state, the resistive means 12 are connected to the conducting wires a, b.

When the first switching means 13 are in an open state, the resistive means 12 are disconnected from the electrical wires a, b.

In this example, the first switching means 13 comprise an on-off switch.

The control means 11 are configured in order to control the state of the first switching means 13.

By default, the first switching means 13 are in the open state, i.e. the resistive means 12 are by default disconnected from the conducting wires a, b.

When the electronic detonator 1 directs a message to the control system 20, the control means 11 control the closure of the first switching means 13.

The control system 20 comprises a control module 21. The control module 21 is configured in order to manage the operation of the control system 20. In particular, the control module 21 manages and sends signals to the electronic detonator 1 and receives messages sent by the electronic detonator 1.

Of course, in the case of an electronic detonation system comprising more than one electronic detonator, le control system 20 sends signals to the array of electronic detonators 1, 2 . . . N and receives messages originating from the array of electronic detonators 1, 2 . . . N.

The control module 21 here comprises two input/output terminals 21*a*, 21*b* and second switching means 22 arranged between the two input/output terminals 21*a*, 21*b*.

In this example, the two input/output terminals 21*a*, 21*b* of the control module 21 of the control system 20 are connected respectively to the two input/output terminals 11*a* and 11*b* of the control means 11 of the electronic detonator 1 respectively, by means of the two conducting wires a, b.

The second switching means 22 have a closed state or an open state. The state of the second switching means 22 is controlled by the control module 21.

It will be noted that when the second switching means 22 are in the closed state, the conducting wires a, b connecting the electronic detonator 1 and the control system 20 are short-circuited.

When the second switching means 22 are in the closed state, the electronic detonator 1 is no longer supplied with power by the control system 20 and thus becomes self-contained.

When the second switching means 22 are in the open state, the two conducting wires a, b connecting the electronic detonator 1 and the control system 20 are not electrically connected, and the electronic detonator 1 is connected to the control system 20. The electronic detonator 1 can thus be supplied with power by the control system 20.

In the embodiment described, the electronic detonator 1, and in particular the control means 11, are configured to implement the method for compensation of a resistance value according to the invention.

In an embodiment, the method is implemented in response to a compensation command received by the electronic detonator 1 and originating from the control system 20.

This compensation command can be transmitted for example during the manufacture of an electronic detonator 1, or during the installation of an electronic detonation system comprising at least one electronic detonator 1 in the field.

The compensation method results in setting the total resistance (resistance formed by the resistance of the conducting wires a, b and the resistance of the resistive means 12) at a predetermined value.

In an embodiment, the predetermined value is sent in the compensation command.

In another embodiment, the predetermined value is stored in a memory of the electronic detonator 1 prior to the implementation of the compensation method.

For example, the predetermined value can be stored in a memory 15 of the electronic detonator 1 during the manufacture of the electronic detonator 1.

In another example, the predetermined value can be sent by the control system 20 to the electronic detonator 1, for example during powering-up of the electronic detonation system once installed in the field.

In the embodiment described, the second switching means 22 are commanded to the closed state by the control module 21 of the control system 20 when a compensation command is directed to the electronic detonator 1. As described above, once the second switching means 22 are in the closed state, power is no longer supplied to the electronic detonator 1 by the control system 20 and is thus self-contained.

When the electronic detonator 1 receives a compensation command, it implements the method for the compensation of a resistance value.

Thus, when the compensation command is transmitted during the manufacture of the electronic detonator, the value of the second resistance is determined depending on the length of the conducting wires a, b connecting the electronic detonator 1 and the control system 20. When the compensation command is transmitted during the installation of the electronic detonation system in the field, the value of the second resistance is determined as a function of the length of the conducting wires a, b and the installation conditions of the electronic detonation system in the field.

The method comprises determining the value of the second resistance such that the sum of the values of the first resistance and the second resistance is substantially equal to a predetermined value.

Once the value of the second resistance is determined, the control means 11 command the resistive means 12 so that its resistance is set to the value of the second resistance.

In particular, the control means 11 apply a signal to the resistive means 12 so as to set its resistance to the value of the second resistance.

For example, when the resistive means 12 comprise an MOS transistor, the control means 11 apply a voltage to the gate of the MOS transistor.

In an embodiment, the method comprises measuring the value of the first resistance. In order to implement this measurement, the control module 11 of the electronic detonator 1 commands the opening of the first switching means 13. Thus, the resistive means 12 are disconnected from the conducting wires a, b.

It will be noted that the conducting wires a, b are electrically connected together (short-circuited) at the second switching means 22 in the control system 20.

The measurement step comprises a step of applying a predetermined voltage to the conducting wires a, b, followed by a step of measuring the current passing through the conducting wires a, b, as well as the second means of communication 22 (which are in the closed state).

In the embodiment described, the step of applying a predetermined voltage is implemented by the control means 11 of the electronic detonator 1.

Once the control means 11 have determined the value of the first resistance (corresponding to the resistance of the conducting wires a, b), the control means 11 implement the determination of the value of the second resistance, the value of the second resistance being such that the sum of the values of the first resistance and the determined second resistance is substantially equal to the predetermined value.

In another embodiment, which can be used during the manufacture of an electronic detonator, the value of the first resistance is determined depending on the length of the conducting wires a, b without the need to implement measurements. In this case, the value of the first resistance is a predefined value.

This predefined value can be stored in memory, corresponding to a length of the conducting wires a, b or determined as a function of parameters stored in memory relating to the conducting wires a, b.

The predefined value can thus be directed by the control system 20 to the electronic detonator 1 in the compensation command, this value then being stored in a memory of the electronic detonator 1.

Thus, the electronic detonator 1 can receive a compensation command containing the predetermined value and the predefined value corresponding to the first resistance.

In another embodiment, the predefined value can be pre-recorded in a memory of the electronic detonator 1 during the manufacture of the electronic detonator 1.

In an embodiment, determining the value of the second resistance can be implemented by control system 20.

In this embodiment, once the value of the second resistance is determined, the control system 20 directs a command for setting the value of the second resistance to the determined value.

This command for setting the value of the second resistance to a determined value can be used during the manufacture of an electronic detonator or the installation of an electronic detonation system comprising at least one electronic detonator in the field.

The steps of the method, in particular the determination of the second resistance and the measurement of the first resistance, are identical and will not be described again here.

In such a variant, the measurement or the determination of the value of the first resistance is implemented by control means 21 in the control system 20.

Moreover, the value of the second resistance is determined by the control means 21 of the control system 20.

It will be noted that the first resistance is not measured but determined (by the electronic detonator 1 or by the control system 20) and has a predefined value stored in a memory, the compensation method is implemented during the manufacture of the electronic detonator.

In fact, when the value of the first resistance is not measured but determined, determining this value does not take account of the installation conditions of the detonation system in the field, but only of the length of the conducting wires a, b.

In the case in which the value of the first resistance is measured by the control means 21 of the control system 20, the second switching means 22 are situated in the electronic detonator 1.

In this case, when the control system directs a compensation command to the electronic detonator, the control module of the electronic detonator commands the closure of the second switching means and the method is implemented.

In the case of an electronic detonation system comprising a control system 20 and an array of electronic detonators 1, 2 . . . N, the value of the second resistance is determined for each electronic detonator 1, 2 . . . N.

The control system 20 sends nominative compensation commands to the electronic detonators 1, 2, . . . N, i.e. it sends a compensation command to each electronic detonator 1, 2, . . . N individually. Thus, the compensation method is implemented in the array of electronic detonators 1, 2, . . . N sequentially.

In an embodiment, when the control system 20 directs a command to an electronic detonator, the remainder of the electronic detonators 1, 2, . . . N of the array can enter into a state of high impedance, so as to reduce the electricity consumption of the electronic detonation system.

In the embodiment in which the second switching means are in the electronic detonator, the control system can only send compensation commands to a single electronic detonator 1, 2, . . . N at a time.

The invention claimed is:

1. An electronic detonator configured to be connected by two conducting wires to an associated control system, the two conducting wires made of a charged plastic material and having a first resistance, said electronic detonator comprising:

a resistive element arranged between the two conducting wires that are made of the charged plastic material, said resistive element having a second resistance; and a hardware controller programmed to apply the second resistance, a value of the second resistance being determined by the hardware controller such that a sum of a value of the first resistance and the value of the second resistance is substantially equal to a predetermined value that is determined prior to determining the value of the second resistance, the sum of the value of the first resistance and the value of the second resistance having a constant value that is independent of the lengths of the conducting wires.

2. The electronic detonator according to claim 1, wherein the resistive element comprises an MOS transistor.

3. The electronic detonator according to claim 1, further comprising a switch arranged in series with said resistive element, said switch being capable of being in a closed state in which said resistive element is connected to the two conducting wires, or an open state in which said resistive element is disconnected from at least one of the two conducting wires.

4. An electronic detonation system comprising:

at least one electronic detonator according to claim 1; and an associated control system connected to said at least one electronic detonator by the two conducting wires made of the charged plastic material.

5. The electronic detonation system according to claim 4, wherein the control system comprises a switch arranged between the two conducting wires, said switch being capable of being in an open state in which the two conducting wires are not electrically connected, or a closed state in which the two conducting wires are electrically connected.

6. A method for the compensation of a resistance value in an electronic detonator, the method comprising:

connecting an electronic detonator by two conducting wires to an associated control system, the two conducting wires being made of a charged plastic material and having a first resistance, the electronic detonator comprising a resistive element arranged between the two conducting wires and having a second resistance; and determining a value of the second resistance, by a controller of the electronic detonator, such that a sum of a value of the first resistance and the value of the second resistance is substantially equal to a predetermined value that is determined prior to determining the value of the second resistance, the sum of the value of the first resistance and the value of the second resistance having a constant value that is independent of the lengths of the conducting wires.

7. The compensation method according to claim 6, further comprising measuring the value of the first resistance.

8. The compensation method according to claim 7, wherein measuring the value of the first resistance comprises applying a predetermined voltage across the two conducting wires, and measuring current passing through the two conducting wires when the two conducting wires are electrically connected together.

9. The compensation method according to claim 8, wherein measuring the value of the first resistance is implemented by a controller in said electronic detonator.

10. The compensation method according to claim 8, wherein measuring the value of the first resistance is implemented by a controller in the control system.

11. The compensation method according to claim 6, wherein the value of the first resistance is a predefined value.

12. The compensation method according to claim 6, wherein the method is implemented by the electronic detonator when the control system transmits a command for compensation of a resistance value.

13. The compensation method according to claim 12, wherein said command for compensation of the resistance value contains said predetermined value.

14. The compensation method according to claim 12, further comprising sending said predetermined value to the electronic detonator, said predetermined value being stored in a storage in the electronic detonator, said sending being implemented prior to transmitting the command for compensation of a resistance value.

15. The compensation method according to claim 11, further comprising sending said predetermined value to the electronic detonator, said predetermined value being stored in the storage in the electronic detonator, said sending being implemented prior to transmitting a command for compensation of a resistance value.

16. The compensation method according to claim 6, wherein the method is implemented by the control system, and the method further comprises setting the second resistance to a determined value.

17. The electronic detonator according to claim 2, further comprising a switch arranged in series with said resistive element, said switch being capable of being in a closed state in which said resistive element is connected to the two conducting wires, or an open state in which said resistive element is disconnected from at least one of the two conducting wires.

18. The compensation method according to claim 7, wherein the method is implemented by the electronic detonator when the control system transmits a command for compensation of a resistance value.

19. The compensation method according to claim 18, wherein said compensation command contains said predetermined value.

* * * * *